US009440715B2

(12) United States Patent
Rizzo

(10) Patent No.: US 9,440,715 B2
(45) Date of Patent: Sep. 13, 2016

(54) BOARD FOR TRAVELING IN OCEAN SURF AND METHOD OF FABRICATING SAME

(71) Applicant: John Rizzo, Oceanside, CA (US)

(72) Inventor: John Rizzo, Oceanside, CA (US)

( * ) Notice: Subject to any disclaimer, the term of this patent is extended or adjusted under 35 U.S.C. 154(b) by 64 days.

(21) Appl. No.: 14/548,636

(22) Filed: Nov. 20, 2014

(65) Prior Publication Data

US 2016/0144934 A1 May 26, 2016

(51) Int. Cl.
*B63B 35/79* (2006.01)

(52) U.S. Cl.
CPC ..... *B63B 35/7906* (2013.01); *B63B 35/7936* (2013.01)

(58) Field of Classification Search
CPC ... B63B 35/58; B63B 35/79; B63B 35/7909; B63B 35/81; B63B 35/812
USPC ..... 441/65, 74
See application file for complete search history.

(56) References Cited

U.S. PATENT DOCUMENTS 3,289,227 A * 12/1966 Kelly, Jr. ..... B63B 35/7906 441/74
3,543,315 A 12/1970 Hoffman
4,028,761 A 6/1977 Taylor
4,619,619 A 10/1986 Muse, Jr.
D290,151 S 6/1987 Cashmere
4,805,546 A 2/1989 Geller et al.
4,883,436 A 11/1989 Oakland
D305,145 S 12/1989 Shanelec
5,257,953 A 11/1993 Gillis
5,273,470 A 12/1993 Sneddon et al.
5,700,174 A 12/1997 Churchill et al.
5,941,540 A 8/1999 O'Haire
6,305,305 B1 10/2001 Johnson
7,144,285 B1 12/2006 Hendricks
2012/0115378 A1 5/2012 Strover et al.

FOREIGN PATENT DOCUMENTS

JP 23 2011-037282 2/2011
WO WO 2006/092020 A1 9/2006

* cited by examiner

*Primary Examiner* — Lars A Olson
(74) *Attorney, Agent, or Firm* — Walter S. Stevens

(57) ABSTRACT

Board for traveling in ocean surf and method of fabricating same. The board includes a platform having a generally planer configuration. The platform includes a pair of relatively deep anti-slip knee wells of sufficient depth in the top surface thereof for allowing a surfer to make radical changes in board motion using his knees. According to an embodiment of the board, a channel extends along a portion of a bottom surface of the platform or optionally along the entire bottom surface of the platform for stabilizing the platform's trajectory, increasing the speed of the platform, and adding drive and direction to the platform while maneuvering in the ocean surf.

32 Claims, 25 Drawing Sheets

BOARD FOR TRAVELING IN OCEAN SURF AND METHOD OF FABRICATING SAME

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO A SEQUENCE LISTING, A TABLE, OR A COMPUTER PROGRAM LISTING COMPACT DISC APPENDIX

Not applicable.

FIELD OF THE INVENTION

This invention generally relates to recreational aquatic devices and more particularly relates to a board which is used for surfing or riding ocean waves.

BACKGROUND OF THE INVENTION

There are various types of recreational aquatic devices used to surf or ride ocean waves. Examples of such devices include surfboards, kneeboards, body boards, and wake boards. These examples are briefly discussed immediately hereinafter, so that the utility of the present invention can be better appreciated.

Wake boards are used when the user is being towed by a boat and while riding the wake created by the boat. Users sometimes employ a wake board when it is desired to launch the board and user into the air to perform tricks, such as spins, while being towed. Thus, a wake board is designed to be towed by a motorized boat using a tow rope and may require the presence of towing apparatus affixed to the wakeboard.

However, a consideration associated with wake boards is that towing apparatus may be required on the wake board and a motorized boat must be present in order to use the wake board. Scheduling and obtaining the presence of the motorized boat can be inconvenient and costly for the user. Also, the presence of towing apparatus on the wake board can increase manufacturing costs associated with the wake board. In addition, wake boards are not designed for use in ocean surf.

A full-sized surfboard is configured to be used with the surfer in a standing position and offers a choice of maneuvers, such as the "cutback" or "snap" maneuver, wherein the surfer turns the surfboard while riding a wave. Full-sized surfboards have one or more rigid or flexible fins outwardly extending from and perpendicular to the bottom surface of the surfboard for stabilizing and maintaining the surfboard's trajectory. Also, due to presence of the bottom fins, performing a 180 degree or 360 degree turn is generally performed while the rider is in the air. Full-sized surfboards can also enable paddling out to a wave, as well as wave catching.

However, a consideration associated with the use of full-sized surfboards is that due to their greater mass and presence of fins, full-sized surfboards generally create a greater risk of blunt force injury and lacerations to nearby swimmers and surfers. In addition, due to their greater mass and presence of fins, full-sized surfboards also create a greater risk of blunt force injury and lacerations to the individual riding the surfboard, if the individual falls from the surfboard and remains in the vicinity of the surfboard after falling.

The purpose of a kneeboard differs from the purpose of a full-sized surfboard. In this regard, a kneeboard is designed to be used with the surfer in a kneeling position and offers maneuverability, stability, and the ability to fit in tight sections on a wave. In contrast to a kneeboard, a full-sized surfboard is designed to be used with the surfer in a standing position and has less maneuverability, less stability, and is less able to fit in tight sections on a wave.

A body board (also referred to in the art as a "boogie-board" or a "sponge") is configured to be used with the surfer lying in a prone position on the board. A body board offers a faster learning curve for use, is lighter than a surfboard and can, therefore, reduce risk of injury to the rider or nearby surfers and swimmers, and is more stable in the water compared to a surfboard. Body boards typically lack attached fins in order to provide maneuverability for performing surfing tricks in unusual positions, such as the "drop knee" surfing position wherein the surfer is partially kneeling on the body board with one knee near the back of the board and one foot near the front of the board. Some surfers use the drop knee surfing position to make a 360 degree turn that is commonly referred to in the art as a "360 turn". The 360 turn is a maneuver that can be done on the flat section of a wave, in the white foam, off the lip of the wave or in the air while riding prone or drop knee riding. As previously mentioned, body boards typically lack fins in order to provide maneuverability for performing surfing tricks. However, it should be noted that surfers using body boards wear flexible swim fins on their feet, when it is desired to stabilize the trajectory of the body board. Hence, the swim fins substitute for the fins that might otherwise be attached to the bottom of the body board. Also, surfers using body boards wear swim fins on their feet to propel the body board through the water in order to paddle out to a wave or for matching the speed of a wave while surfing.

However, a consideration associated with use of a body board is that a body board can create greater risk of irritation of the user's abdomen or blunt abdominal trauma due to the user lying on his abdomen while surfing. Another consideration is the number of maneuvers one can perform are limited by the prone position of the rider or the instability of the board should the rider decide to rise from the prone position.

Attempts have been made to address the considerations mentioned hereinabove with respect to recreational aquatic devices, such as conventional kneeboards, body boards, surfboards, and wake boards. For example, U.S. Pat. No. 4,028,761 titled "Multipurpose Slide" issued Jun. 14, 1977 in the name of John Taylor relates to a slide for supporting a human passenger in the kneeling position during sports activity on water or during skiing activity on sand, snow or other suitable media.

According to the Taylor patent, a slide has knee wells with a depth approximately equal to one quarter of the thickness of the board and a foam pad affixed in the knee wells. Although the slide is primarily employed to transport a passenger in the kneeling position, it may easily be ridden in the standing position, according to the Taylor patent. If the slide is used for surfing in the standing position, a skag (i.e., fin) may be added to its bottom. This patent also states that the slide is referred to as a multipurpose slide rather than a surfboard, as it is used more frequently by towing behind power boats and snowmobiles than in the surf.

However, the Taylor device does not appear to disclose that the knee wells are used for any purpose other than as a resting place for the user's knees. Also, the Taylor patent does not appear to disclose a complete absence of the need for towing behind power boats and snowmobiles. In addition, the Taylor patent does not appear to disclose that the slide is exclusively for use in surf and on ocean waves.

Another attempt to address the considerations mentioned hereinabove with respect to recreational aquatic devices, such as conventional kneeboards, is disclosed in U.S. Pat. No. 4,619,619 titled "Combination Surfboard-Kneeboard" issued Oct. 28, 1986, in the name of Lauchlin M. Muse, Jr. This patent relates to a combination surfboard-kneeboard.

According to the Muse, Jr. disclosure, the combination surfboard-kneeboard can be utilized for either surfing or knee-boarding and is designed to be machine made rather than hand-crafted. The combination surfboard-kneeboard is provided with a set of detachable fins. Certain fins can be selected and used for surfing while other fins can be selected and used for knee-boarding. Thus, the Muse, Jr. patent appears to disclose that the fin configuration for surfing can be converted to the fin configuration for knee-boarding and vise versa. Also, this patent discloses that, in conventional knee-boarding, the fins can be entirely removed when desired.

However, the Muse, Jr. patent does not appear to disclose that the board is fin-free at all times without a need for conversion. Also, the Muse, Jr. patent does not appear to disclose enhancing maneuverability of the board when used as a kneeboard, other than by conversion of fins or removal of fins. This patent does not appear to disclose enhancing maneuverability of the board by any other means. Also, this patent does not expressly disclose a pair of knee wells for accommodating the knees of the user when the board is used as a kneeboard.

Although the approaches recited hereinabove disclose various configurations of recreational aquatic devices, such as conventional kneeboards, wake boards, body boards, and full-sized surfboards, the approaches recited hereinabove do not appear to disclose the invention described and claimed hereinbelow.

BRIEF SUMMARY OF THE INVENTION

The present invention addresses the shortcomings and considerations of the prior art approaches mentioned hereinabove by providing a suitable board for traveling in ocean surf and a method of fabricating the board. The board of the present invention comprises a platform having a generally planer configuration and a pair of relatively deep depressions or knee wells in the top surface of the platform. The knee wells not only accommodate the surfer's knees while the surfer rides the board in a kneeling position, but the relatively deep knee wells also allow the surfer to make radical changes in board motion by using his knees while twisting his body. The relatively deep knee wells are configured to allow the surfer to use his knees in this manner without sliding off the board. Also, the side walls of the knee wells may be sloped (i.e., slanted) inwardly or outwardly for comfortably accommodating the knees of the user, as needed. In addition, the knee wells may be reinforced with a liner, so that repeated use of the knee wells does not distort the predetermined shape of the knee wells. Moreover, a plurality of ridges may be included in each knee well to mitigate risk that the surfer's knees will slide out of the knee wells while the surfer makes changes in board motion. This is a departure from the prior art because conventional prior art kneeboards have relatively shallow knee wells merely for resting the knees of the surfer therein and, therefore, are incapable of allowing one to make radical changes in board motion using only one's knees.

The knee wells extend from the back of the board to approximately the midpoint of the board. The knee wells may be formed in the board, so as to extend parallel to each other or may each be individually angled toward or away from each other to accommodate the kneeling posture of a particular user. The knee wells may be produced from a mold or may be shaped or cut from a preformed blank. The side walls and/or floor of the knee wells may be lined with the same material used to produce the board or lined with a different suitable material or combination of suitable materials. The knee wells may be formed separately and inserted into preformed slots in the board. The front most portion of each knee well may be vertical or tapered toward the front of the board or the rear of the board. When tapered toward the front or rear of the board, one or both knee wells may define a recessed space or cavity for the rider to position one of his feet while riding in a drop knee position.

Conventional board configurations, such as conventional surfboards and some conventional kneeboards, typically include one or more fins on the underside of the board for stabilizing the board's trajectory. The board of the present invention lacks conventional fins on the underside of the board at all times, but can still stabilize the board's trajectory and enhance maneuvering of the board. This is due, at least in part, to the presence of one or more channels extending along the bottom surface of the board. Presence of the channel or channels also increases speed of the board when riding forward down a wave and adds drive and direction when making turns, depending on the position and weight distribution of the rider's knees in the knee wells. In addition, when compared to conventional surfboards and some conventional kneeboards, the board of the present invention lessens risk of blunt force injury and lacerations to nearby swimmers and surfers. This is so because the board of the present invention has less mass than some boards, such as surfboards, and does not include conventional fins at any time.

According to an aspect of the present invention, there is provided a board for traveling in ocean surf, comprising a platform having a predetermined length, the platform having a top surface, a bottom surface, a front end portion and a rear end portion, the top surface defining a pair of knee wells therein of sufficient depth to facilitate guiding the platform, the bottom surface defining a center-most channel therein extending along a portion of the predetermined length of the platform or optionally along the entire predetermined length of the platform.

According to another aspect of the present invention, there is provided a board for traveling in ocean surf, comprising a platform having a predetermined length, the platform having a top surface, a bottom surface, a front end portion and a rear end portion, the top surface defining a pair of knee wells therein of sufficient depth to facilitate guiding the platform.

According to another aspect of the present invention, there is provided a board for traveling in ocean surf, comprising: (a) a platform having a predetermined length, said platform having a top surface, a bottom surface, a front end portion and a rear end portion, the top surface defining a pair of knee wells therein of sufficient depth to facilitate guiding said platform, the bottom surface defining a center-most channel therein extending along a portion of the predetermined length of said platform or optionally along the entire predetermined length of said platform for increased speed of said platform; and (b) a core disposed intermediate the top surface and the bottom surface for strengthening said platform.

According to another aspect of the present invention, there is provided a board for traveling in ocean surf, comprising a platform having a predetermined length, the platform having a top surface, a bottom surface, a front end portion and a rear end portion, the top surface defining a pair of knee wells therein having a depth of about 50% to about 99% the thickness of the platform to facilitate guiding the platform.

According to yet another aspect of the present invention there is provided a method of fabricating a board for traveling in ocean surf, comprising the steps of: (a) providing a platform having a predetermined length, the platform having a top surface, a bottom surface, a front end portion and a rear end portion; (b) forming a pair of knee wells of sufficient depth in the platform to facilitate guiding the platform in the ocean surf; and (c) forming a center-most channel in the bottom surface of the platform, the channel extending along a portion of the predetermined length of the platform or optionally along the entire predetermined length of the platform.

Any materials and techniques common to the art of manufacturing kneeboards, body boards, wake boards, or surfboards can be used. This may include, but not limited to, cores or blanks cut to a predetermined length and width out of polymer sheets, or molded cores, injected or cast, made from polymer materials. Standard polymers include, but are not limited to, polystyrene, polyethylene, polyurethane, and/or polypropylene. The kneeboards, body boards, wake boards, and surfboards may be reinforced with any suitable material and using any suitable methodology. Such methods commonly used in the art include, but are not limited to use of stringers, mesh, resin, or any combination thereof. The individual components are assembled and affixed to each other by methods known in the art. These methods include, but are not limited to, the use of resins or glues, the use of heat, the use of fasteners, or any combination thereof.

A feature of the present invention is the provision of a platform having a top surface defining a pair of knee wells therein of sufficient depth to facilitate guiding the platform with a surfer's knees.

An additional feature of the present invention is the provision of a top surface that may comprise one or more layers of material to provide comfort and water resistant capabilities. This material may consist of, but not limited to, polymers or resins, such as SURLYN® isomer resin polyethylene, polypropylene, polyurethane, and combinations thereof. The mark SURLYN® is a registered trademark of E.I. du Pont de Nemours and Company located in Wilmington, Del. U.S.A.

Another feature of the present invention is the provision of a bottom surface that may comprise one or more layers of material to provide strength, durability, and water resistant capabilities. This material may consist of, but not limited to, polymers or resins, such as SURLYN® isomer resin polyethylene, polypropylene polyurethane, and combinations thereof.

Yet another feature of the present invention is the provision of a platform having a bottom surface defining a center-most channel therein extending along a portion of the predetermined length of the platform or optionally along the entire predetermined length of the platform.

An additional feature of the present invention is the provision of a board that is free of conventional fins at all times.

A further feature of the present invention is the provision of a method of fabricating a board including the steps of providing a platform having a predetermined length, the platform having a top surface and a bottom surface; forming a pair of knee wells of sufficient depth in the top surface of the platform; and forming a center-most channel in the bottom surface of the platform.

In addition to the foregoing, various other method and/or device aspects and features are set forth and described in the teachings, such as text (e.g., claims and/or detailed description) and/or drawings of the present invention.

The foregoing is a summary and thus may contain simplifications, generalizations, inclusions, and/or omissions of detail. Consequently, those skilled in the art will appreciate that the summary is illustrative only and is not intended to be in any way limiting. In addition to the illustrative aspects, embodiments, and features described hereinabove, further aspects, embodiments, and features will become apparent by reference to the drawings and the following detailed description.

BRIEF DESCRIPTION OF THE SEVERAL VIEWS OF THE DRAWINGS

The invention will be more fully understood by reference to the detailed description in conjunction with the following figures, wherein.

DETAILED DESCRIPTION OF THE INVENTION

Figure 1:
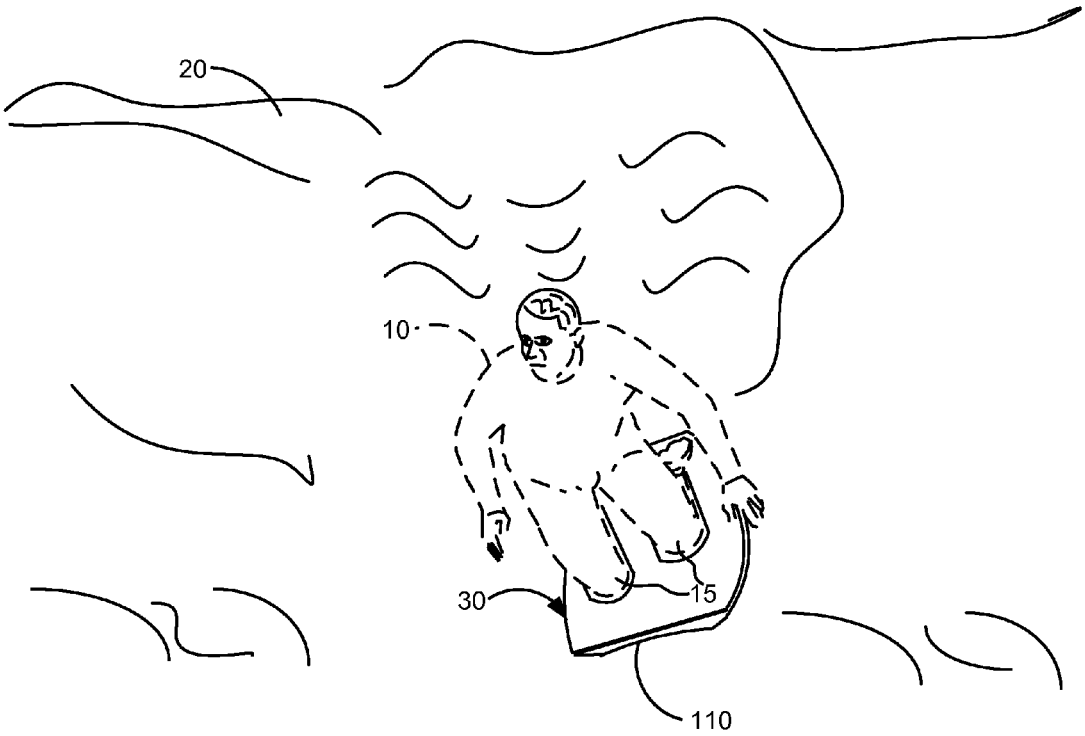
FIG. 1 illustrates a board for traveling in ocean surf and a surfer kneeling on the board.

In the following detailed description, reference is made to the accompanying drawings, which form a part hereof. In the drawings, similar symbols typically identify similar components, unless the context dictates otherwise. The illustrative embodiments described in the detailed description, drawings, and claims are not meant to be limiting. Other embodiments may be utilized, and other changes may be made, without departing from either the spirit or scope of the invention.

In addition, the present patent specification uses formal outline headings for clarity of presentation. However, it is to be understood that the outline headings are for presentation purposes, and that different types of subject matter may be discussed throughout the specification (e.g., device(s)/structure(s), may be described under process(es)/operations heading(s) and/or process(es)/operations may be discussed under structure(s) process(es) headings; and/or descriptions of single topics may span two or more topic headings). Hence, the use of the formal outline headings is not intended to be in any way limiting.

Therefore, with reference to FIG. 1, there is shown a surfer 10 riding an ocean wave 20 while kneeling on a board 30 configured according to the invention. Compared to conventional kneeboards, board 30 is capable of increased speed while simultaneously enhancing maneuverability and stability.

Figure 2:
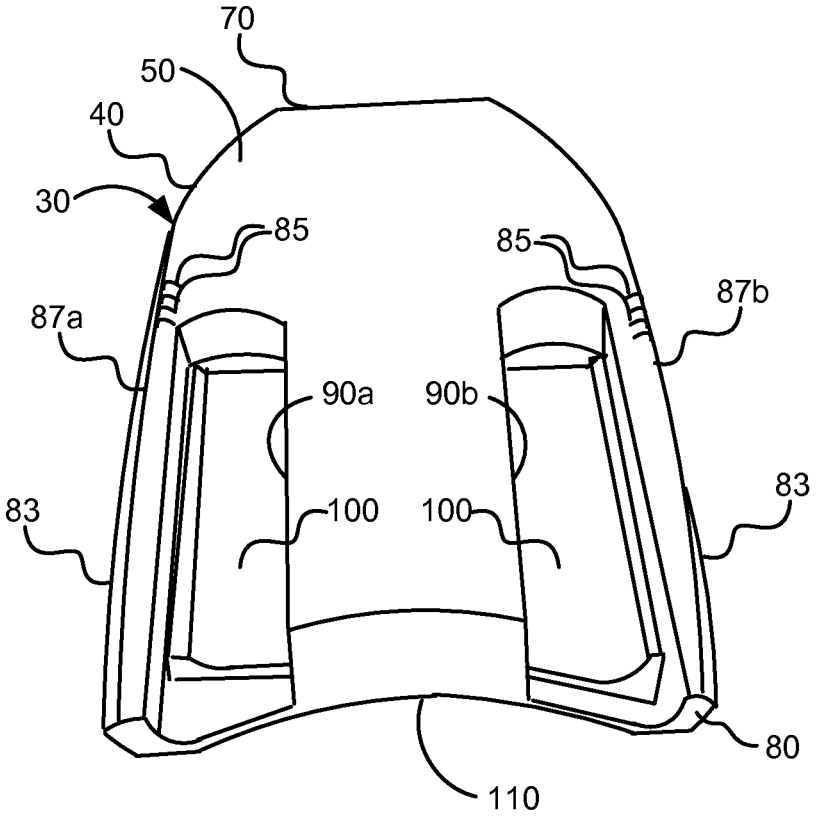
FIG. 2 is a view in perspective of a board defining a pair of knee wells therein and a cushion disposed within each knee well.
Figure 3:
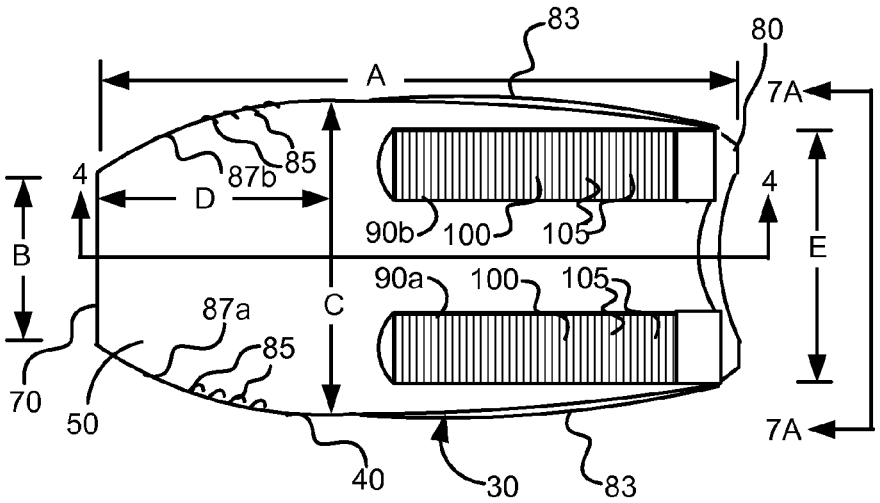
FIG. 3 is a top plan view of the board, the knee wells having a cushion within each knee well, each cushion defining a plurality of transversely-oriented anti-slip ridges thereon.
Figure 4:
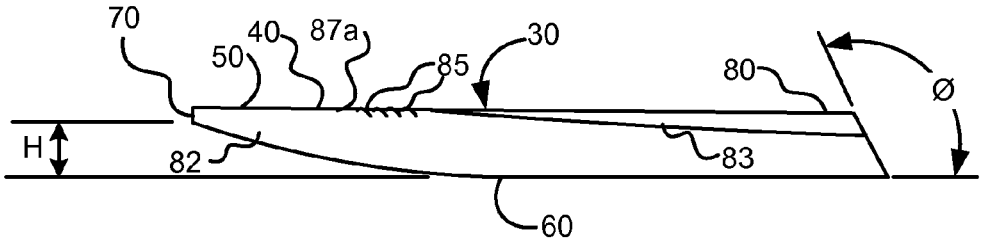
FIG. 4 is a view in side elevation of the board, the board having an upturned rocker front end portion.
Figure 5:
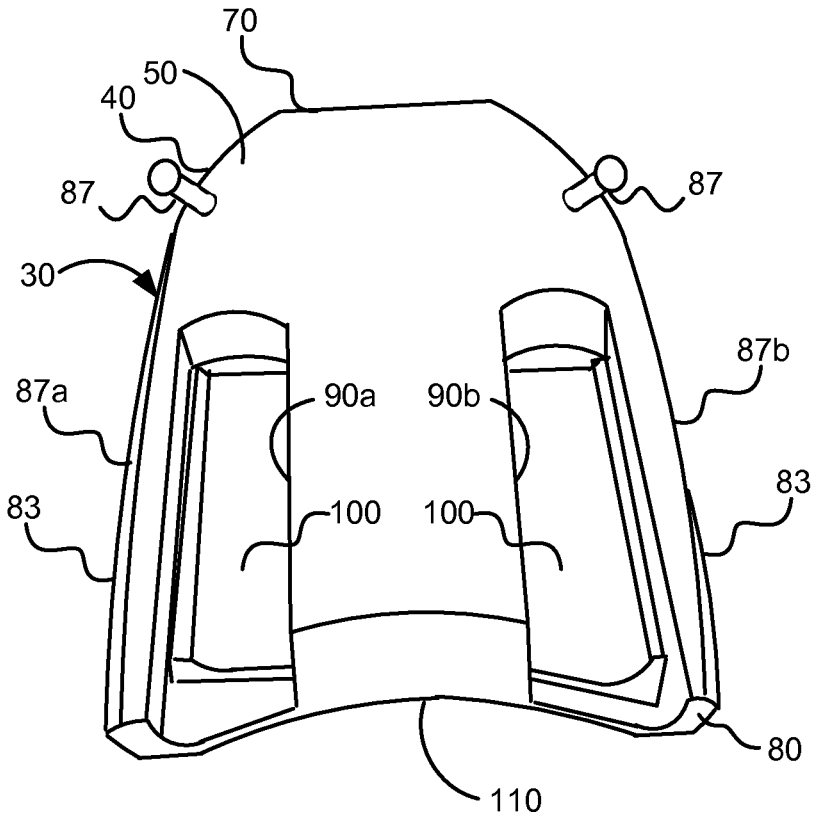
FIG. 5 is a view in perspective of the board, this view showing a pair of handles connected to the board.
Figure 6:
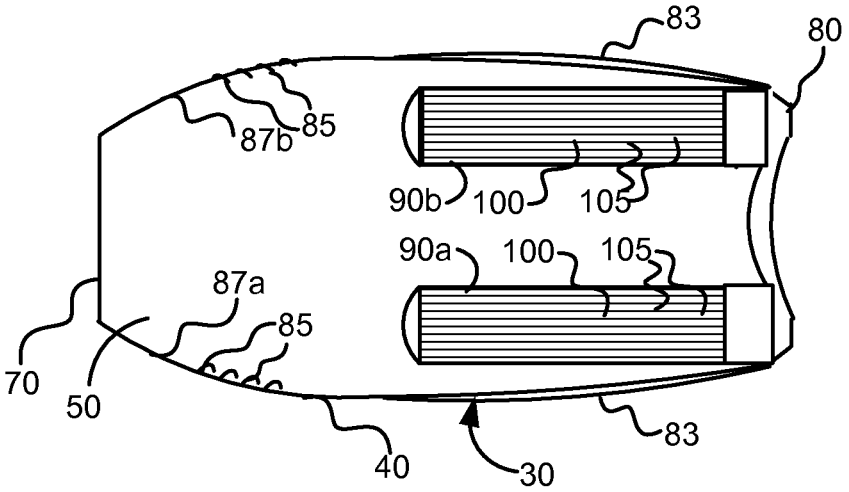
FIG. 6 is a top plan view of the board, the knee wells having a cushion within each knee well, each cushion defining a plurality of longitudinally-oriented anti-slip ridges thereon.
Figure 7:
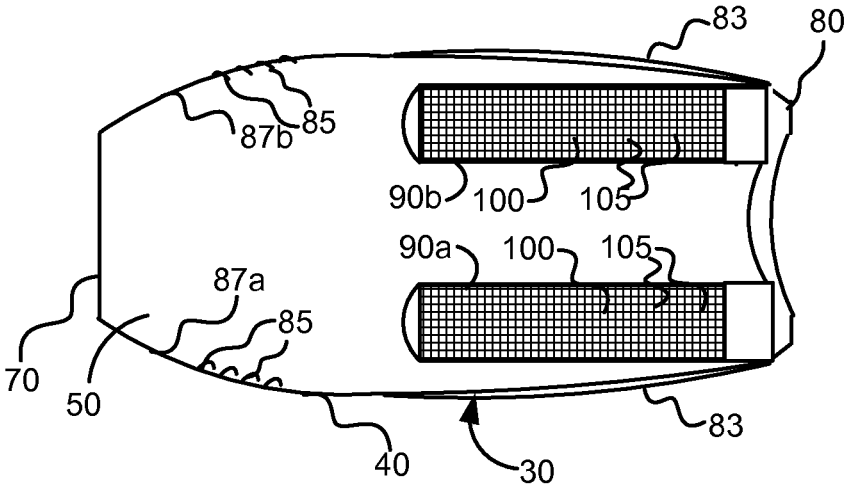
FIG. 7 is a top plan view of the board, the knee wells having a cushion within each knee well, each cushion defining a plurality of transversely-oriented and longitudinally-oriented anti-slip ridges thereon.
Figure 7A:
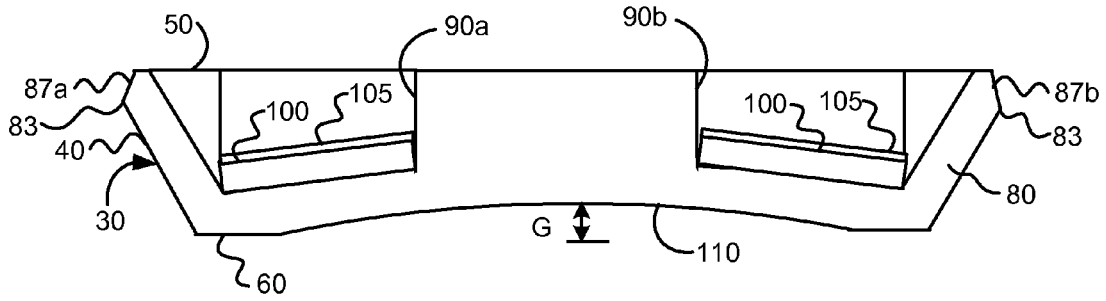
FIG. 7A is a view in elevation of a rear end portion of the board.
Figure 8:
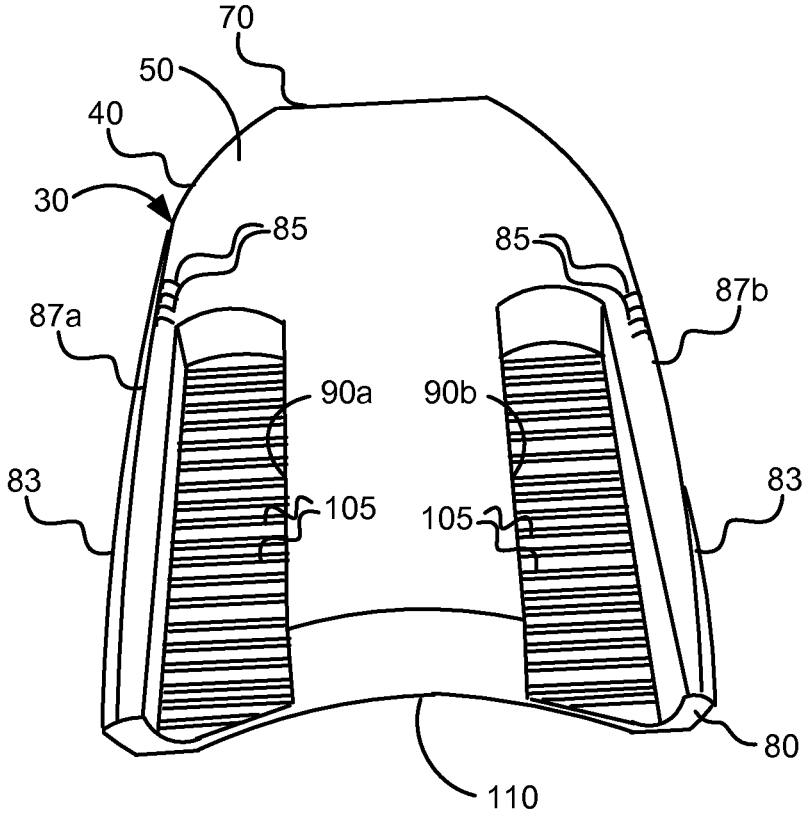
FIG. 8 is a view in perspective of the board, the cushions being absent and the knee wells defining a plurality of transversely-oriented anti-slip ridges integrally formed in the board.
Figure 9:
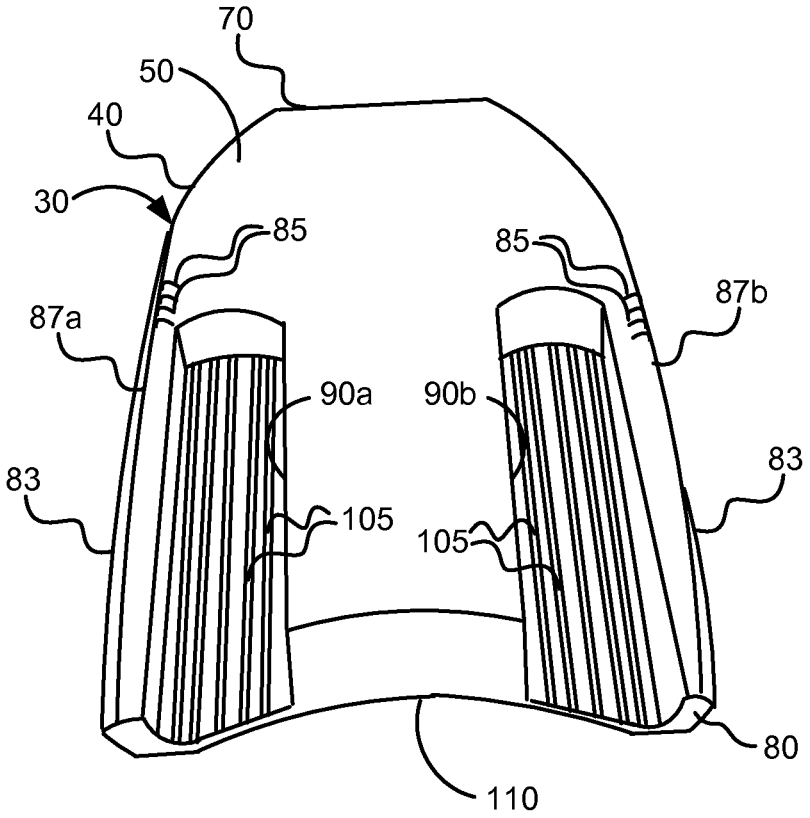
FIG. 9 is a view in perspective of the board, the cushions being absent and the knee wells defining a plurality of longitudinally-oriented anti-slip ridges integrally formed in the board.
Figure 10:
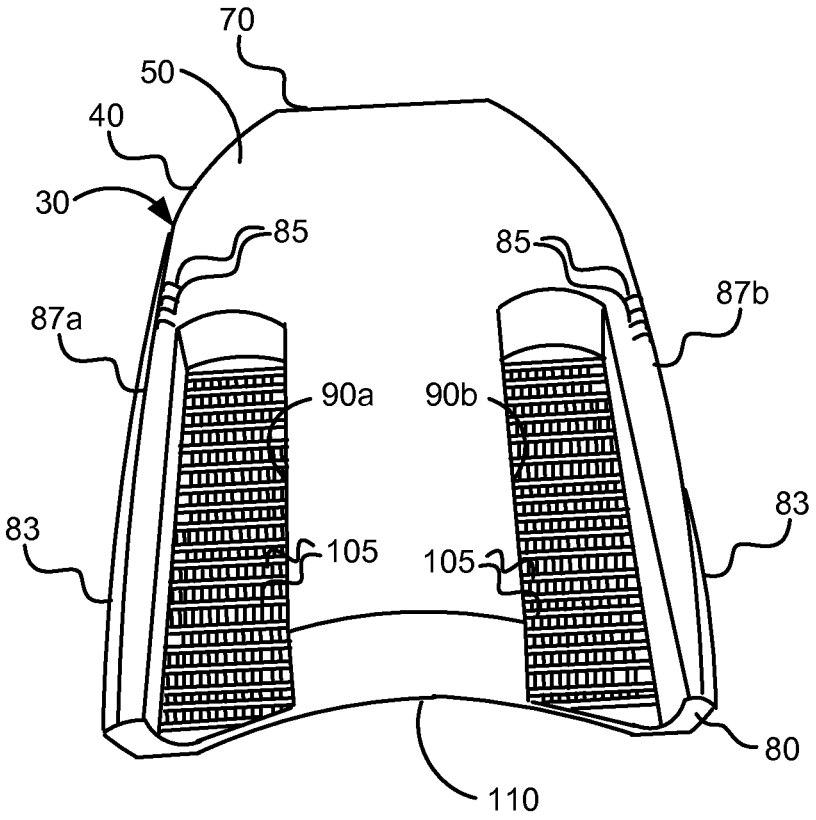
FIG. 10 is a view in perspective of the board, the cushions being absent and the knee wells defining a multiplicity of transversely-oriented and longitudinally-oriented anti-slip ridges integrally formed in the board.
Figure 11:
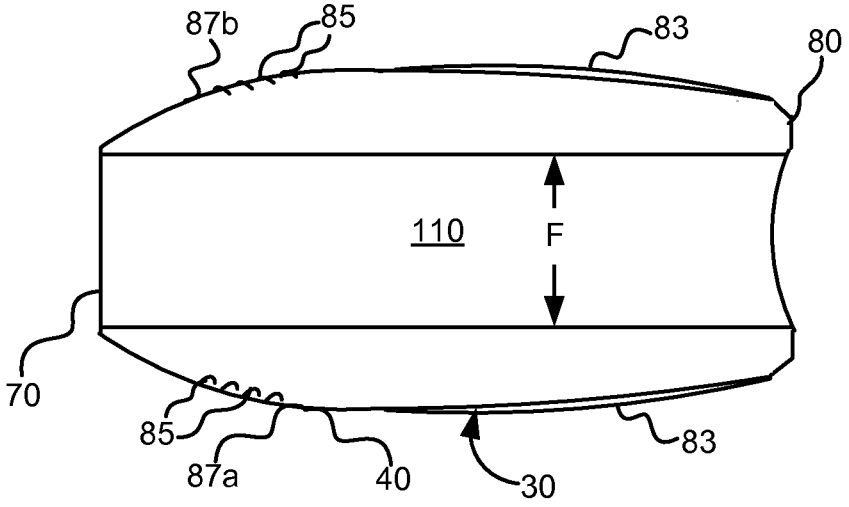
FIG. 11 is a bottom plan view of the board, the board having a blunt front end portion in combination with a channel extending along an entire bottom surface of the board.

Referring to FIGS. 2, 3 and 4, an embodiment of board 30 comprises a generally planer platform 40 having a top surface 50, a bottom surface 60, a non-pointy, blunt or truncated front end portion 70, and an inwardly canted tail or rear end portion 80. In this regard, rear end portion 80 is canted at a predetermined angle "Ø" (theta) for reasons provided hereinbelow. By way of example only, and not by way of limitation, the angle "Ø" may be approximately 45 degrees from the horizontal. Front end portion 70 forms an upturned "nose" defining a "two-stage" front rocker 82 for increasing lift of board 30 as board 30 gains speed in ocean wave 20. The "two-stage" rocker is defined herein to mean a upwardly bent or upturned portion of board 30, wherein the bent portion or upturned portion is only at one end of board 30, such as the front end portion 70 of board 30. The terminology "lift" is defined herein to mean a force generated by buoyancy and hydraulic lift acting generally perpendicularly to bottom surface 60 of platform 40. Also, front rocker 82 pushes more water in front of platform 40 in order to provide a slower riding experience. Thus, a vertical height "H" of rocker 82 from the horizontal affects speed of platform 40. Vertical height "H" is measured from the horizontal plane of bottom surface 60 (see FIG. 4). More specifically, a smaller height "H" of rocker 82 increases lift, decreases hydraulic drag and therefore increases speed. A larger height "H" of rocker 82 decreases lift, increases hydraulic drag and therefore decreases speed. For the purpose of illustration only, and not for the purpose of limitation, the height "H" of rocker 82 may obtain a value of between about 3.5 inches (88.5 millimeters) and about 5 inches (127 millimeters). The desired amount of height "H" for rocker 82 is selected during manufacture of board 30. The ankles and feet of surfer 10 may extend beyond rear end portion 80 while surfer 10 kneels on platform 40. Rear end portion 80, which need not have a rocker, is inwardly canted at the predetermined angle "Ø" to avoid interference with free movement of the ankles and feet of surfer 10 as surfer 10 kneels on platform 40.

Referring again to FIGS. 2, 3 and 4, a pair of rails 83 that are integrally formed with platform 40 runs at least partially along respective sides of platform 40 from about the middle of the sides of platform 40 to the extremis of rear end portion 80. Rails 83 contact the water when surfer 10 turns or maneuvers platform 40. Rails 83 are relatively thin, rather than boxy, to reduce drag and, hence, make it easier for surfer 10 to turn platform 40 into surf 20 and provide lift while surfing.

As best seen in FIG. 3, platform 40 may have any reasonable predetermined dimensions as desired. In this regard, platform 40 has a longitudinal dimension "A", a truncated nose dimension "B" defined by front end portion 70, a maximum lateral width-wise dimension C, a wide point dimension "D" that is the inward distance from the truncated nose defined by front end portion 70 to the maximum lateral width-wise dimension C, and a tail or rear end portion of width E. The values selected for dimensions A-E are predetermined in order to enhance stability and maneuverability and to accommodate the size and physique of surfer 10.

More particularly, platform 40 may have any of a number of suitable and specific dimensions depending on a desired maneuverability of platform 40 and size of surfer 10. By way of example only, and not by way of limitation, dimensions A-E may have the exemplary values shown in the following TABLE:

TABLE

Exemplary Dimensions of Platform 40

| Dimension | Description | Value (inches) | Value (millimeters) |
|---|---|---|---|
| A | Length of platform | 40 | 1016.00 |
| B | Truncated nose dimension defined by front end portion of platform | 12 | 304.80 |
| C | Lateral width of platform | 20 | 508.00 |
| D | Wide point dimension that is the inward distance from the truncated nose defined by the front end portion of the platform to the maximum lateral width-wise dimension of the platform | 15 | 381.00 |
| E | Width of rear end portion | 17 | 431.80 |

Referring to FIGS. 2, 3, 4 and 5, a plurality of grooves 85 is formed in top surface 50 on a pair of opposing edge portions 87*a*/87*b* of platform 40 for providing means for surfer 10 to securely grip platform 40, as needed, while surfing. Therefore, grooves 85 function as a hand-hold for surfer 10. Alternatively, the hand-hold may comprise at least one handle 87 (see FIG. 5), rather than groves 85, upwardly projecting from top surface 50 near opposing edge portions 87*a* and/or 87*b*. The at least one handle 87 provides means for surfer 10 to securely grip platform 40, as needed, while surfing.

Referring to FIGS. 2, 3, 4, 5, 6, 7, 7A, 8, 9 and 10, top surface 50 of platform 40 defines a pair of generally rectangular depressions or knee wells 90*a*/90*b* having a planer bottom for accommodating the knees 15 of surfer 10 while surfer 10 kneels on platform 40. As described more fully hereinbelow, knee wells 90*a*/90*b* are each relatively deep compared to prior art kneeboards having knee depressions, in order to provide means for surfer 10 to maneuver platform 40 while surfing. Also, opposing side walls of knee wells 90*a*/90*b* may be sloped inwardly or outwardly during manufacture of platform 40 for suitably accommodating the knees of the user, as desired. By way of example only, and not by way of limitation, each knee well 90*a*/90*b* may be approximately 2 inches (50.80 millimeters) deep, as measured from top surface 50, and approximately 4.5 inches (114.3 millimeters) wide.

Referring again to FIGS. 2, 3, 4, 5, 6, 7, 7A, 8, 9 and 10, disposed in and substantially conforming to the shape of each knee well 90*a*/90*b* is a resilient, generally rectangular cushion 100 for comfortably receiving the knees of surfer 10. Cushion 100 is formed of any suitable material, such as a polyethylene foam material resistant to salt water degradation. Cushion 100 may be permanently affixed to platform 40 by means of a pressure sensitive permanent adhesive (not shown), such as a resin-based acrylic adhesive comprising an acrylic or methylacrylic polymer. Alternatively, cushion 100 may be temporarily affixed to platform 40 by means of a pressure sensitive removable adhesive, such as an acrylic-based nonpermanent or removable adhesive (also not shown). Such an acrylic-based pressure sensitive removable adhesive allows cushion 100 to be removed, when desired, such as for washing cushion 100 or for replacing a worn cushion 100.

With particular reference to FIGS. 3, 6, 7, 7A, 8, 9 and 10, each cushion 100 may include a plurality of anti-slip ridges 105 formed in a top surface thereof to provide traction and, thereby, to avoid slippage of knees 15 of surfer 10. Preventing slippage of knees 15 of surfer 10 assists in stabilizing the position of surfer 10 relative to platform 40 while surfer 10 kneels on platform 40. Such stabilizing of the position of surfer 10 relative to platform 40 provides surfer 10 with better control of platform 40. Anti-slip ridges 105 may be arranged transversely with respect to cushion 100 (see FIG. 3) for resisting forward and rearward slipping of knees 15 of surfer 10. Alternatively, anti-slip ridges 105 may be arranged longitudinally with respect to cushion 100 (see FIG. 6) for resisting side-to-side or lateral slipping of knees 15 of surfer 10. As yet another alternative, anti-slip ridges 105 may be arranged both transversely and longitudinally with respect to cushion 100 (see FIG. 7) for resisting forward, rearward, and side-to-side slippage of knees 15 of surfer 10. However, it should be appreciated that cushions 100 may be absent, if desired. In this case, anti-slip ridges 105 may be integrally formed in platform 40 (see FIGS. 8, 9 and 10). For example, this can occur if platform 40 is formed from a polymer material in a mold (not shown) using a suitable manufacturing process, such as an injection mold manufacturing process. As another example, anti-slip ridges 105 may be separately manufactured and then separately positioned within knee wells 90*a*/90*b* and connected to platform 40, such as by a suitable permanent adhesive.

Referring again to FIGS. 3, 6, 7, 7A, 8, 9 and 10, surfer 10 kneels on platform 40 such that knees 15 are received in respective ones of knee wells 90*a*/90*b*. In this regard, knee wells 90*a*/90*b* can be sized during manufacture to have a dimension for receiving various sizes of knees 15, so as to accommodate larger size surfers 10 with wider knees or smaller size surfers 10 with narrower knees. As previously mentioned, anti-slip ridges 105 impede shifting or sliding of knees 15 after knees 15 are received in knee wells 90*a*/90*b*. In this regard, it should be appreciated that knees 15 of smaller size surfers will not substantially shift or slide in knee wells 90*a*/909*b*, even when knee wells 90*a*/90*b* are relatively wide, because presence of anti-slip ridges 105 mitigates such shifting or sliding.

Referring to FIGS. 1, 2, 5, 7A, 8, 9, 10 and 11, although not critical or essential, it is nonetheless important that platform 40 define a center-most, arcuate-shaped, open channel 110 of length "A" (see FIG. 3) extending centrally and longitudinally along the entire bottom surface 60 of platform 40. By way of example only, and not by way of limitation, channel 110 may have an arcuate-shaped profile and a width "F" (see FIGS. 1, 2 and 11) of about 20 percent of the widest width "D" (see FIG. 3) of platform 40 and a height "G" (see FIG. 7A) of about 1 percent of the height of platform 40 when measured from the apex of channel 110. In other words, and more simply stated, channel 110 has a width "F" and a height "G". Alternatively, platform 40 can be manufactured, so that platform 40 is flexible enough to allow channel 110 to form as a natural occurrence due to the weight distribution of surfer 10 near the edges of board 30. In other words, platform 40 is flexible enough, such that the spread of surfer's knees 15 and associated weight distribution of surfer 10 while riding platform 40 can bend platform 40 into an arcuate shape that forms channel 110. The purpose of channel 110 is to provide enhanced control of platform 40 while surfer 10 rides wave 20, as described in detail immediately hereinafter.

Referring again to FIGS. 1, 2, 5, 7A, 8, 9, 10 and 11, it should be appreciated that channel 110 acts to propel water through platform 40 and out rear end portion 80 for converting the water flow into lift and forward thrust. Thus, presence of channel 110 increases speed of platform 40. Channel 110 may be formed during manufacture of platform 40. The greater the height "G" and length of channel 110, the more pronounced is lift as well as thrust. By way of example only, and not by way of limitation, the height "G" is contemplated as 3-8 percent of the height of platform 40. It is further contemplated that channel 110 extends the entire length of platform 40 (see FIGS. 7A and 11). Therefore, platform 40 having channel 110 defined therein provides increased lift and thrust for enhancing the surfer's enjoyment while surfing. It is believed channel 110 not only provides faster surfing, but also performs well in large, clean (i.e., non-choppy) surf.

Figure 12:
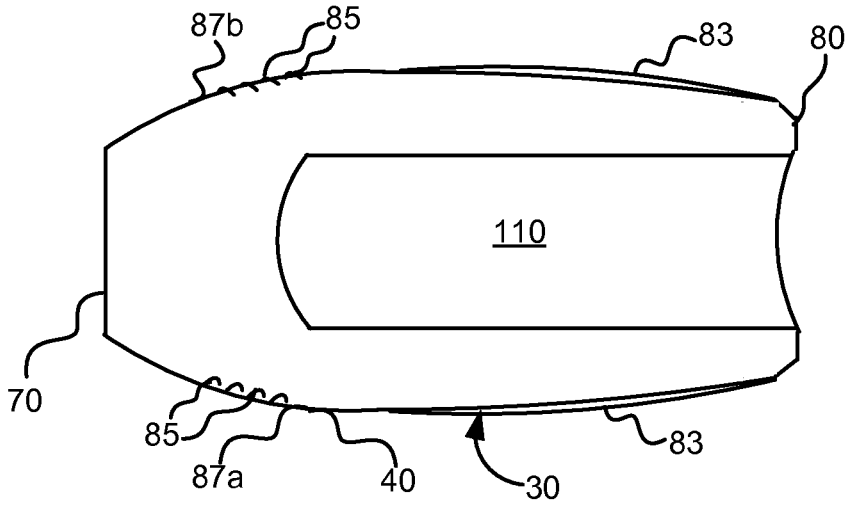
FIG. 12 is a bottom plan view of the board, the board having a blunt front end portion in combination with a channel extending along a portion of the bottom surface of the board.

As best seen in FIG. 12, an alternative configuration of platform 40 is there shown. In this alternative configuration, channel 110 extends from in front of the maximum widthwise dimension "C" of platform 40 (see FIG. 3) to rear end portion 80 of platform 40. Thus, according to this alternative configuration of platform 40, open channel 100 extends centrally and longitudinally along a portion of the bottom surface 60 of platform 40. As previously mentioned, the greater the height "G" and length of channel 110, the more pronounced is lift and thrust. Therefore, shortening the length of channel 110 in this manner should provide a less pronounced lift and thrust. In particular, providing less lift and thrust obtains a slower speed for platform 40. Therefore, varying dimensions of the length and height of channel 110, such as during manufacture of platform 40, allows platform 40 to be more versatile compared to prior art kneeboards because varying dimensions of length and height of channel 110 can provide variously desired amounts of lift and thrust for platform 40.

Figure 12A:
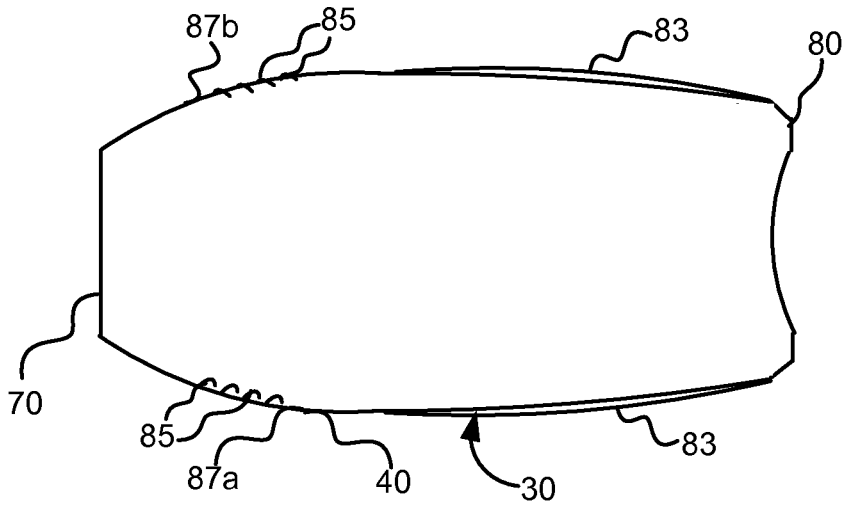
FIG. 12A is a bottom plan view of the board, the board having a blunt front end portion and being without a channel extending along the bottom surface of the board.

Referring to FIG. 12A, another alternative configuration of platform 40 is there shown. In this alternative configuration, channel 110 is absent. Therefore, elimination of channel 110 in this manner should provide far less lift and thrust. In particular, providing less lift and thrust obtains a slower speed for platform 40, which may be desirable for less experienced users or when the weight distribution of surfer 10 does not induce a channel in the manner mentioned hereinabove.

Figure 13:
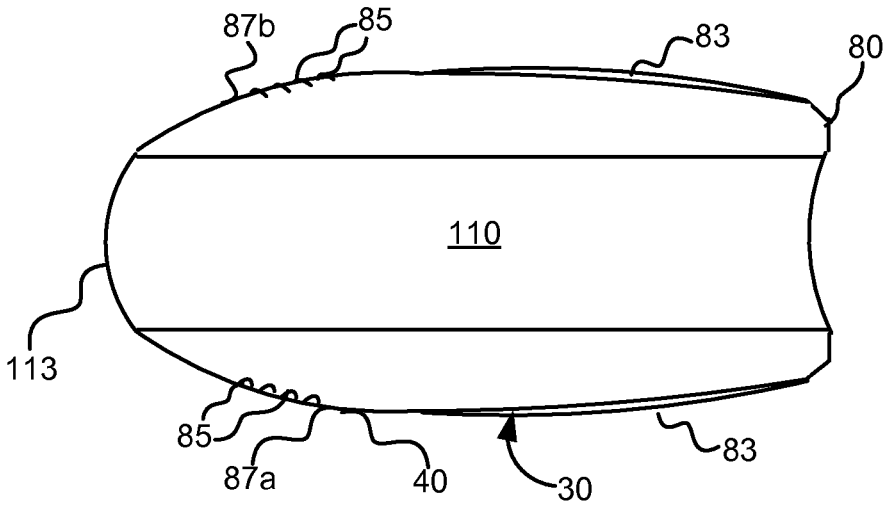
FIG. 13 is a bottom plan view of the board, the board having a rounded front end portion in combination with a channel extending along an entire bottom surface of the board.
Figure 14:
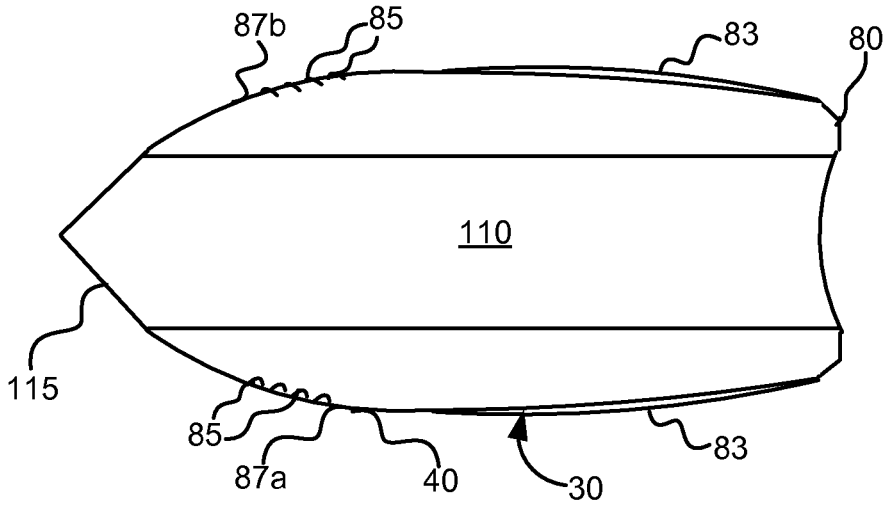
FIG. 14 is a bottom plan view of the board, the board having a pointy front end portion in combination with a channel extending along an entire bottom surface of the board.

Referring to FIGS. 13 and 14, there are shown alternatives to truncated front end portion 70 of platform 40. In this regard, platform 40 may have a rounded front end portion 113 rather than truncated front end portion 70. Rounded front end portion 113 can determine the ability and quickness of platform 40 to catch ocean waves. The greater the width of rounded front end portion 113, the easier it is to catch waves. In addition, a greater width for rounded front end portion 113 is particularly suited for surfing small waves. A lesser width for rounded front end portion 113, the easier it is to maneuver in larger surf. As another alternative, platform 40 may have a pointy front end portion 115 rather than truncated front end portion 70 or rounded front end portion 113. Pointy front end portion 115 also determines the ability of platform 40 to catch ocean waves. However, presence of pointy front end portion 115 can add more curve to previously mentioned rail 81 compared to the truncated front end portion 70 or the rounded front end portion 113 configurations. When the pointy front end portion 115 of platform 40 digs into the water, such as when dropping into a steeper wave, pointy front end portion 115 prevents platform 40 from "pearling" (i.e., platform nose submarining or going underwater). Pearling can cause surfer 10 to loose control of platform 40.

Figure 15:
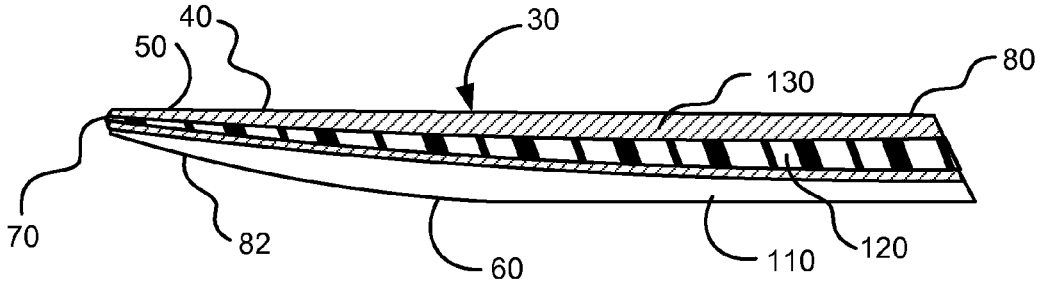
FIG. 15 is a view in vertical section of the board, this view showing a core disposed in the board, the core being made of a polymer material.

Referring to FIG. 15, platform 40 may be surrounded by a fiberglass skin or shell (not shown) having an externally smooth surface, if desired, for protecting platform 40 from damage and for reducing hydrodynamic drag on platform 40 as platform 40 glides on ocean wave 20. In addition, platform 40 may comprise a centrally disposed core 120. Core 120 serves as flotation and may be made of a foam material, which may include polyurethane. Core 120 also serves to strengthen platform 40.

Figure 16:
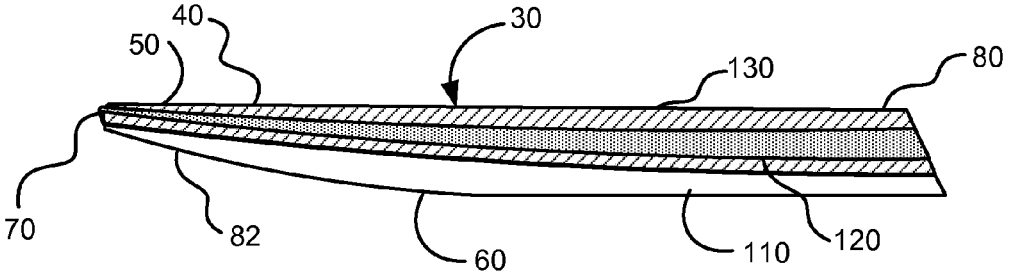
FIG. 16 is a view in vertical section of the board, this view showing a core disposed in the board, the core being made of a wood material.
Figure 17:
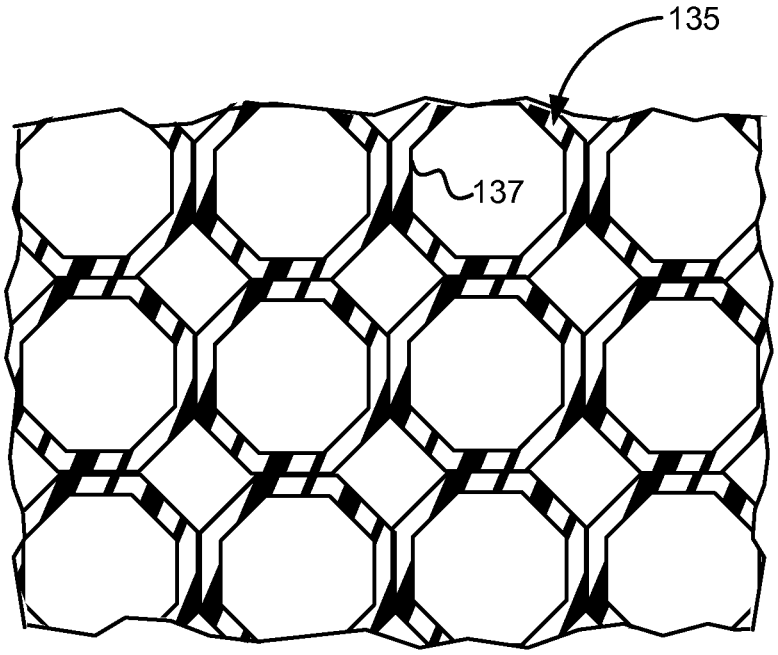
FIG. 17 is a fragmentary view of a core structure comprising a plurality of octagon-shaped cells.

Referring to FIGS. 15, 16 and 17, platform 40 can be hand-crafted or mass produced by conventional manufacturing means. As previously indicated, platform 40 comprises core 120 that serves as flotation material and/or means for strengthening platform 40. Core 120 can be manufactured from a solid sheet of foam material, such as polyurethane, and covered in a fiberglass skin 130 (see FIG. 15). More specifically, multiple layers of fiberglass cloth can be manually laid around core 120. The fiberglass cloth is then bonded to core 120 by a suitable bonding agent, such as an acrylic resin adhesive (e.g., polymethyl acrylate). Fiberglass skin 130 is thereafter painted, polished, and waxed as desired. It is known that fiberglass skins offer greater stiffness in order to allow the surfer to perform more aggressive wave maneuvers. Alternatively, core 120 may comprise a solid sheet of wood particles mixed with resin (see FIG. 16) for achieving floatation and/or stiffness. As another alternative, rather than a solid sheet of material, core 120 can have a honeycomb structure 135 defined by a plurality of integrally connected cells 137, wherein each cell 137 of honeycomb structure 135 has eight sides, in transverse cross section, for increased strength. Therefore, each cell 137 obtains an octagon shape (eight sided shape) in transverse cross section rather than, for example, a hexagon shape (six sided shape) in transverse cross section. It is believed that the increased number of sides obtained by the octagon shape provides more strength than a lesser number of sides that is obtained, for example, by a hexagon shape. By way of example only, and not by way of limitation, honeycomb structure 135 may be made of polyurethane.

Figure 18:
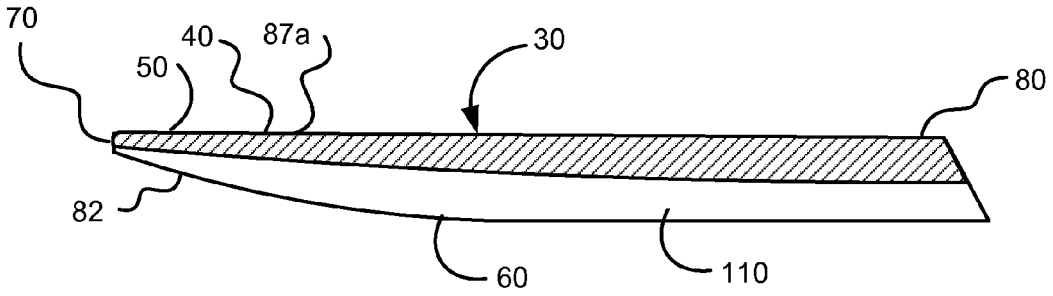
FIG. 18 is a view in elevation of the board, wherein the core is absent, the board being cast from a mold.

Referring to FIG. 18, in yet another embodiment, core 120 might not be used, such that core 120 is absent from the configuration of platform 40. In this case, fiberglass skin 130 is not required or used. Rather, platform 40 is a solid, homogeneous structure machined from, for example, a wood blank or other suitable blank material. The fully machined platform 40 is then polished and painted, as needed. This configuration of platform 40 may be more cost-effective to mass produce compared to manually crafting platform 40 with core 120 and fiberglass skin 130.

Figure 19:
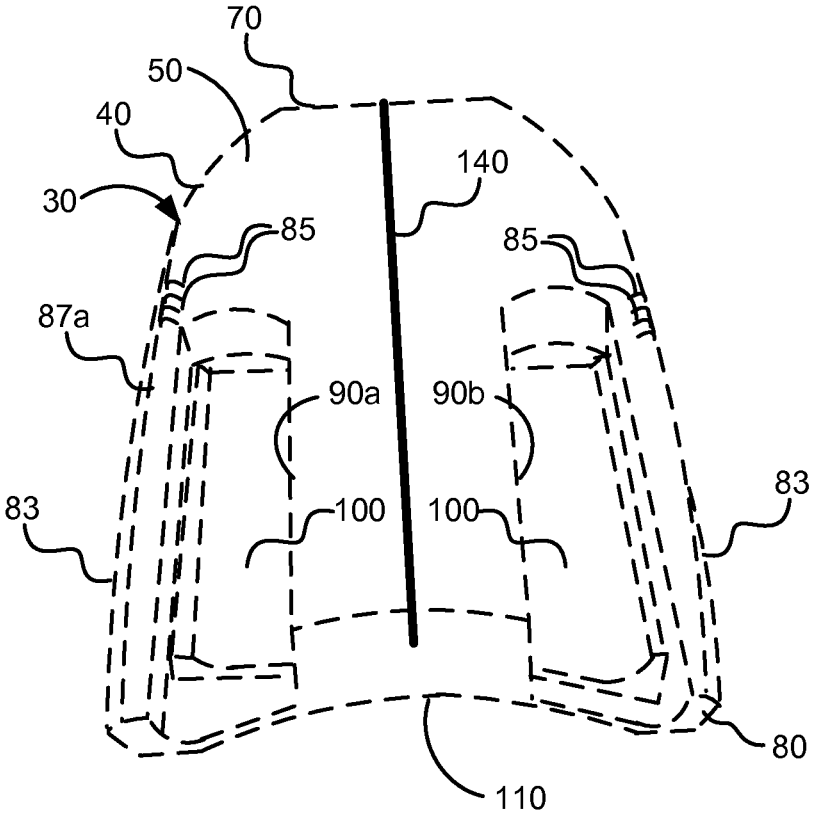
FIG. 19 is a view in phantom perspective of the board, this view showing a stringer embedded in the board.
Figure 19A:
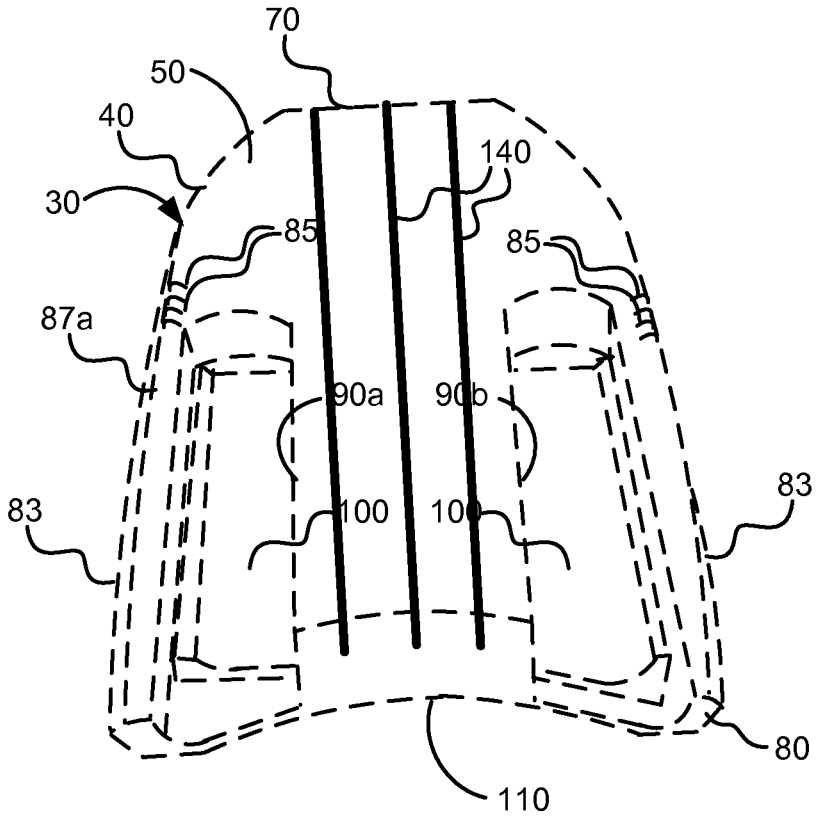
FIG. 19A is a view in phantom perspective of the board, this view showing a plurality of stringers embedded in the board.
Figure 20:
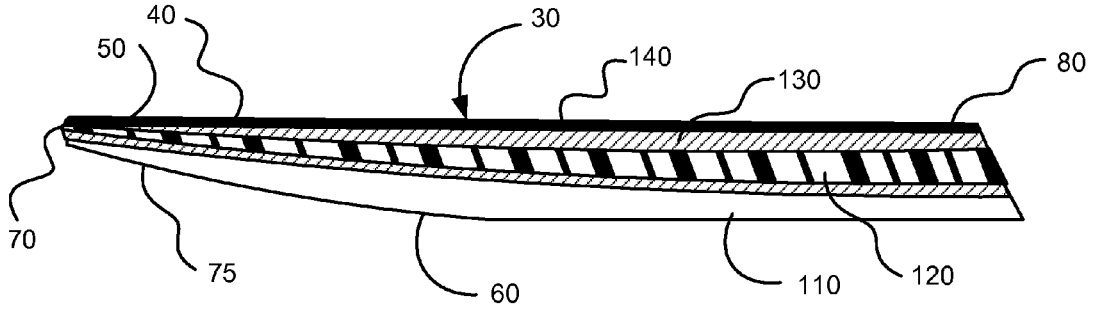
FIG. 20 is a view in vertical section of the board, this view showing a stringer embedded in the board.

Referring to FIGS. 19, 19A and 20, platform 40 can include a reinforcing member, such as a conventional "stringer" 140, embedded in platform 40, if desired, for strengthening platform 40 and for adding rigidity to platform 40, so that platform 40 is less susceptible to breakage. Stringer 140 is an elongate member that extends lengthwise or longitudinally along a center axis of platform 40 and can be made of any suitable material, such as wood, carbon, fiberglass, or other suitable material. There may be a plurality of stringers 140 extending lengthwise or longitudinally along platform 40 for increased strength and rigidity, if desired.

Figure 21:
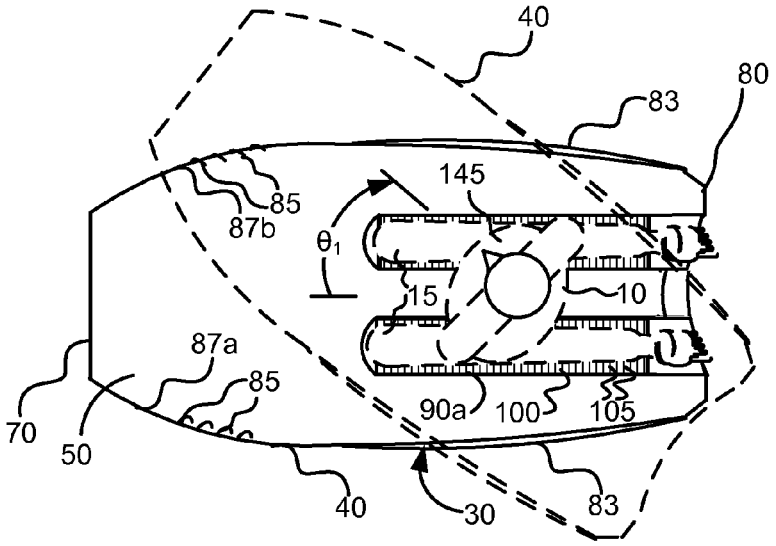
FIG. 21 is a view in plan of the board, this view illustrating a surfer turning the board to his right by twisting his upper torso to the right and, therefore, torquing his knees to the right through an angle $\theta_1$.
Figure 22:
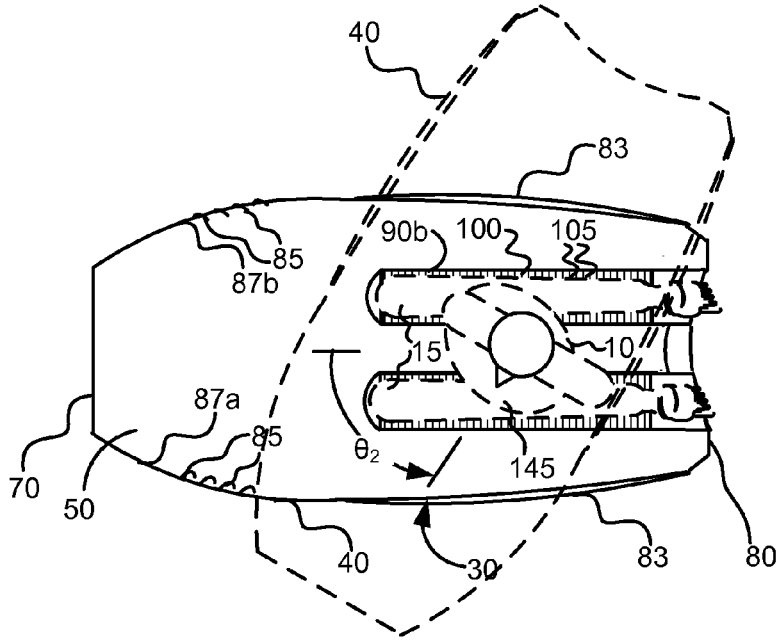
FIG. 22 is a view in plan of the board, this view illustrating the surfer turning the board to his left by twisting his upper torso to the left and, therefore, by torquing his knees to the left through an angle $\theta_2$.
Figure 23:
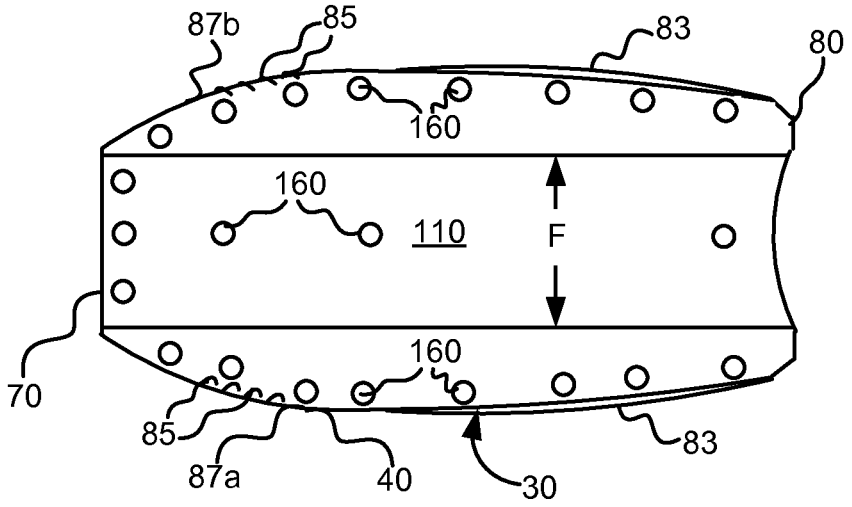
FIG. 23 is a bottom plan view of an alternative embodiment of the board, this view showing a plurality of fasteners inserted into the board for connecting the core and platform together.
Figure 24:
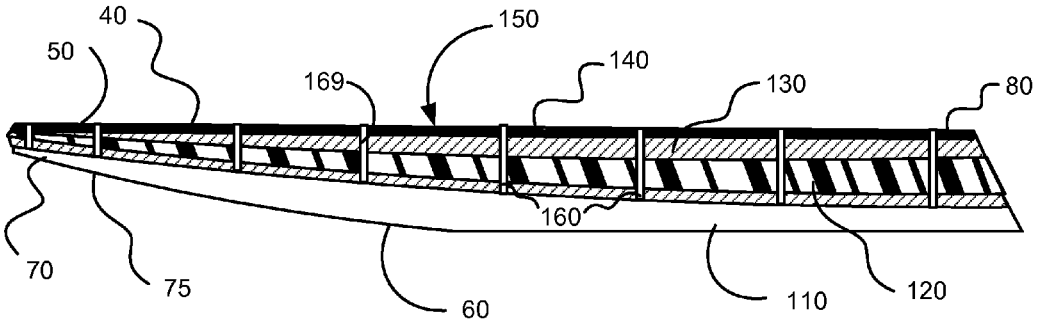
FIG. 24 is a side view in vertical section of the alternative embodiment of the board, this view showing some of the plurality of fasteners inserted into the board for connecting the core and platform together.
Figure 25:
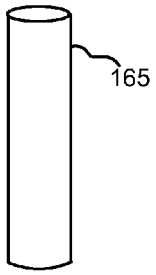
FIG. 25 is a view in perspective of one of the plurality of fasteners in the form of a peg.
Figure 26:
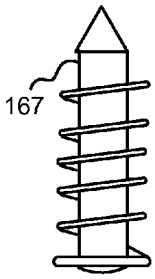
FIG. 26 is a view in elevation of one of the plurality of fasteners in the form of a screw

With reference to FIGS. 21 and 22, relatively deep knee wells 90*a*/90*b* allow surfer 10 to turn platform 40 with his knees 15. To achieve this result, surfer 10 will twist his torso 145, so as to provide a torquing moment of force to his knees 15. Application of this torquing moment of force to knees 15 of surfer 10 causes the surfer's knees 15 to rotate, such as through a first angle "$\theta_1$" (phi sub-one) or a second angle "$\theta_2$" (phi sub-two) that is selected by surfer 10. Rotation through first angle $\theta_1$ rotates platform 40 in an arc extending to the right of surfer 10, as shown. Rotation through second angle $\theta_2$ rotates platform 40 in an arc extending to the left of surfer 10, as shown. Thus, rotation of knees 15 in the desired direction and in the desired amount causes platform 40 to rotate left or right to a like extent. Previously mentioned anti-slip ridges 105 substantially prevent knees 15 from shifting or slipping while knees 15 are received in knee wells 90*a*/90*b*, so that knees 15, and therefore platform 40, rotate more precisely the desired extent. Thus, knee wells 90*a*/90*b* and anti-slip ridges 105 allow surfer 10 to precisely turn or rotate platform 40 hands-free for obtaining a more exhilarating riding experience.

Turning now to FIGS. 23, 24, 25, and 26, there is shown another alternative embodiment of the board, generally referred to as 150. Board 150 is substantially similar to the embodiment of board 30 shown in FIG. 20, except board 150 comprises a plurality of vertically-oriented fasteners 160, which may be cylindrically-shaped pegs 165 or, optionally, screws 167. Pegs 165, or optionally, screws 168 connect core 120 and platform 40 together. Thus, pegs 165, or optionally screws 167, engage core 120 and platform 40 and are thereby used to connect core 120 and platform 40 together instead of adhesive to connect core 120 and platform 40 together, if desired. When pegs 165 are used, pegs 165 are inserted into respective ones of a plurality of holes 169 formed in platform 40 and are held in holes 169 by means of a press-fit or other suitable means.

Figure 27:
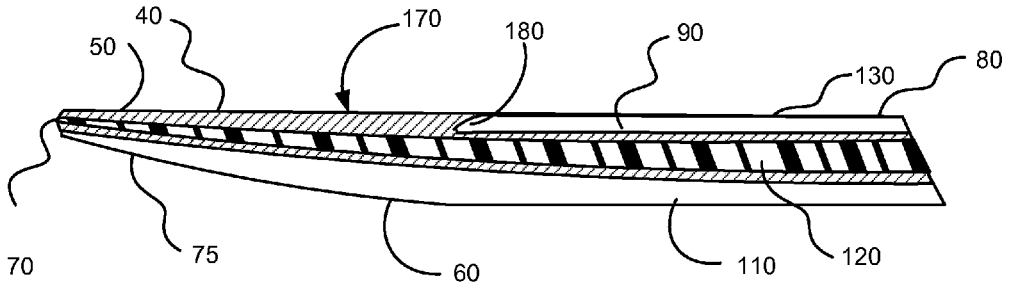
FIG. 27 is a side view in vertical section of another alternative embodiment of the board, this view showing one of a pair of knee wells, the knee well defining a toe-hold cavity therein.
Figure 28:
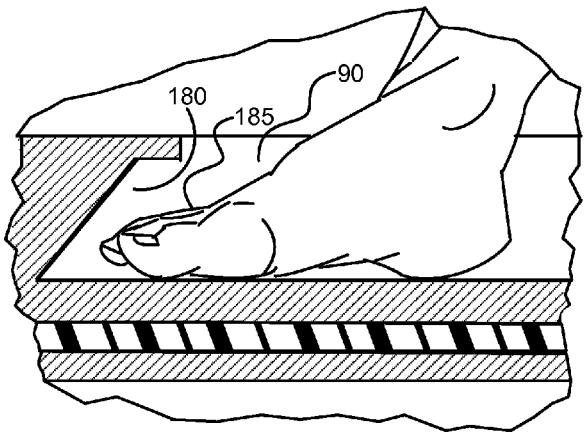
FIG. 28 is a fragmentary view in vertical section of a portion of the board, this view showing the toe-hold cavity receiving a portion of a surfer's foot.

Referring to FIGS. 27 and 28, there is shown another alternative embodiment of the board, generally referred to as 170. Board 170 is substantially similar to the embodiment of board 30 shown in FIG. 20, except board 170 defines a "toe-hold" cavity or recessed space 180 in a forward portion of either or both of knee wells 190*a*/190*b*. A purpose of recessed space 180 is to accommodate a portion 185 of one of the feet of surfer 10 as surfer 10 rides surf 20 in the previously mentioned "drop knee" surfing position.

Figure 29:
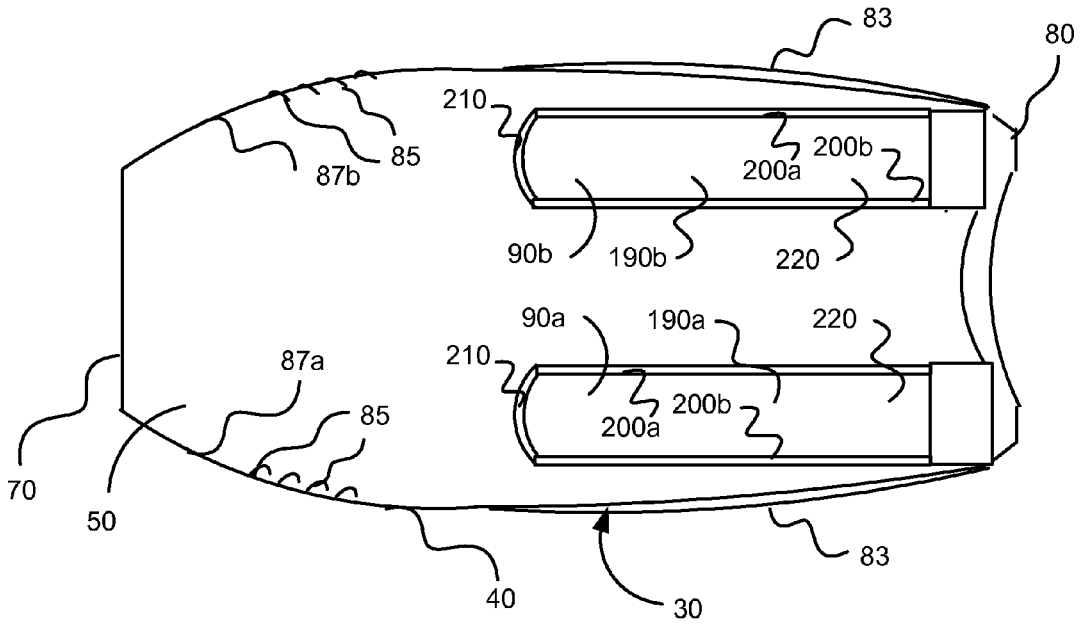
FIG. 29 is a view in plan of another alternative embodiment of the board, this view showing each knee well having a liner disposed therein.

As shown in FIG. 29, a pair of rigid liners 190*a* and 190*b* may be disposed in respective ones of knee wells 90*a* and 90*b* for reinforcing knee wells 90*a*/90*b*, so that knee wells 90*a*/90*b* retain their original, generally rectangular shape after repeated use. Each liner 190*a*/190*b* includes a pair of vertically-oriented and oppositely disposed sidewalls 200*a*/200*b* integrally connected to a vertically-oriented front wall 210. Sidewalls 200*a*/200*b* and front wall 210 are integrally connected to a horizontally-oriented floor 220. Liners 190*a*/190*b* may be affixed within respective knee wells 90*a*/90*b*, such as by means of a suitable adhesive. Previously mentioned cushion 100 may be placed on each floor 220 of liners 190*a*/190*b*.

It should be appreciated that fabrication of board 30 can be performed by the same procedures used for making conventional surfboards, body boards, wake boards and kneeboards, if desired. The procedures used for cutting a template or shaping the template can be used to form knee wells 90*a*/90*b*, if desired.

Illustrative Methods:

An illustrative method associated with an exemplary embodiment for fabricating a board according to the invention will now be described.

Figure 30:
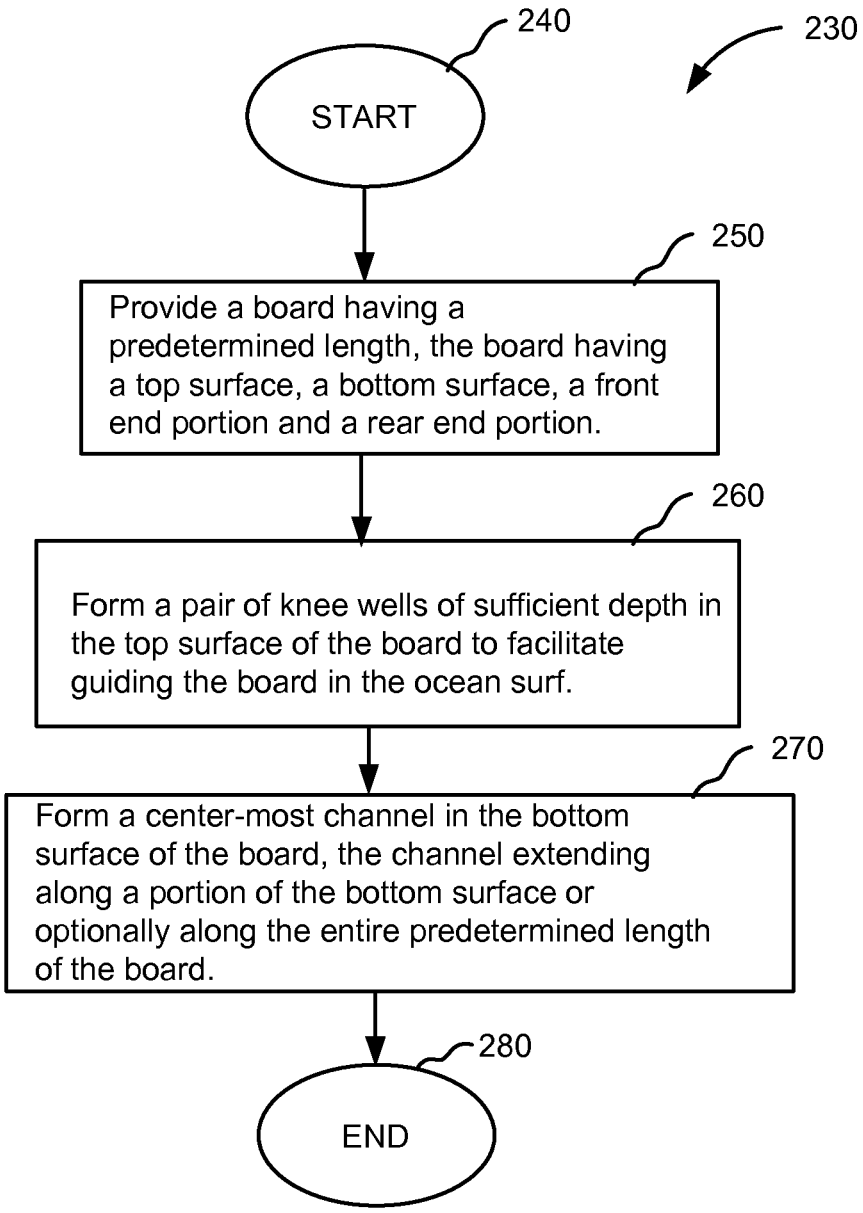
FIG. 30 is a flowchart showing an illustrative method of fabricating the board.

Referring to FIG. 30, an illustrative method, generally referred to as 230, of fabricating a board for traveling in ocean surf is provided. The method starts at a step 240. At a step 250, a platform having a predetermined length is provided, the platform having a top surface, a bottom surface, a front end portion and a rear end portion. At a step 260, a pair of knee wells of sufficient depth is formed in the top surface of the platform to facilitate guiding the platform in the ocean surf. At a step 270, a center-most channel is formed in the bottom surface of the platform, the channel extending along a portion of the predetermined length of the platform or optionally along the entire predetermined length of the platform. The method stops at a step 280.

Other modifications and implementations will occur to those skilled in the art without departing from the spirit and the scope of the invention as claimed. For example, rear end portion 80 may be upwardly-turned to form a rocker, rather than being inclined at an angle "O", in order to add maneuverability and lift to rear end portion 80 and provide tail sensitivity in critical turns. As another example, knee wells 90*a*/90*b* may be manufactured as separate components and added to hollowed-out portions in platform 40, such hollowed-out portions having been formed in a pre-cut board template or blank. Accordingly, the description hereinabove is not intended to limit the invention, except as indicated in the following claims.

The claims will be interpreted according to law. However, and notwithstanding the alleged or perceived ease or difficulty of interpreting any claim or portion thereof, under no circumstances may any adjustment or amendment of a claim or any portion thereof during prosecution of the application or applications leading to issuance of a patent from this patent application be interpreted as having forfeited any right to any and all equivalents thereof that do not form a part of the prior art.

All of the features disclosed in this specification may be combined in any combination. Thus, unless expressly stated otherwise, each feature disclosed is only an example of a generic series of equivalent or similar features.

It is to be understood that while the invention has been described in conjunction with the detailed description thereof, the foregoing description is intended to illustrate and not limit the scope of the invention, which is defined by the scope of the appended claims. Thus, from the foregoing, it will be appreciated that, although specific embodiments of the invention have been described herein for the purpose of illustration, various modifications may be made without deviating from the spirit and scope of the invention. Other aspects, advantages, and modifications are within the scope of the following claims and the present invention is not limited except as by the appended claims.

The specific methods and compositions described herein are representative of preferred embodiments and are exemplary and not intended as limitations on the scope of the invention. Other objects, aspects, and embodiments will occur to those skilled in the art upon consideration of this specification, and are encompassed within the spirit of the invention as defined by the scope of the claims. The invention illustratively described herein suitably may be practiced in the absence of any element or elements, or limitation or limitations, which is not specifically disclosed herein as essential. Thus, for example, in each instance herein, in embodiments or examples of the present invention, the terms "comprising", "including", "containing", etc. are to be read expansively and without limitation. The methods and processes illustratively described herein suitably may be practiced in differing orders of steps, and that they are not necessarily restricted to the orders of steps indicated herein or in the claims.

The terms and expressions that have been employed are used as terms of description and not of limitation, and there is no intent in the use of such terms and expressions to exclude any equivalent of the features shown and described or portions thereof, but it is recognized that various modifications are possible within the scope of the invention as claimed. Thus, it will be understood that although the present invention has been specifically disclosed by various embodiments and/or preferred embodiments and optional features, any and all modifications and variations of the concepts herein disclosed that may be resorted to by those skilled in the art are considered to be within the scope of this invention as defined by the appended claims.

The invention has been described broadly and generically herein. Each of the narrower species and subgeneric groupings falling within the generic disclosure also form part of the invention. This includes the generic description of the invention with a proviso or negative limitation removing any subject matter from the genus, regardless of whether or not the excised material is specifically recited herein.

It is also to be understood that as used herein and in the appended claims, the singular forms "a," "an," and "the" include plural reference unless the context clearly dictates otherwise. Also, the term "X and/or Y" means "X" or "Y" or both "X" and "Y", and the letter "s" following a noun designates both the plural and singular forms of that noun. In addition, where features or aspects of the invention are described in terms of Markush groups, it is intended and those skilled in the art will recognize that the invention embraces and is also thereby described in terms of any individual member or subgroup of members of the Markush group.

Other embodiments are within the following claims. The patent may not be interpreted to be limited to the specific examples or embodiments or methods specifically and/or expressly disclosed herein. Under no circumstances may the patent be interpreted to be limited by any statement made by any Examiner or any other official or employee of the U.S. Patent and Trademark Office unless such statement is specifically and without qualification or reservation expressly adopted in a responsive writing by Applicant(s).

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

Therefore, provided herein are a board for traveling in ocean surf and a method of fabricating same.

What is claimed is:

1. A board for traveling in ocean surf, comprising a platform having a predetermined length, said platform having a top surface, a bottom surface, a front end portion and a rear end portion, the top surface defining a pair of knee wells therein capable of accommodating knees of a user of said platform, the knee wells being of sufficient depth to facilitate guiding said platform by rotation of the knees of the user thereof in a desired direction and in a desired amount to cause said platform to rotate left or right to an extent, the bottom surface defining a center-most channel therein extending along a portion of the predetermined length of said platform or optionally along the entire predetermined length of said platform.

2. The board of claim 1, wherein the front end portion of said platform is square-shaped.

3. The board of claim 1, wherein the front end portion of said platform has an upturned contour.

4. The board of claim 1, further comprising a core disposed in said platform.

5. The board of claim 4, further comprising a fastener engaging said platform and said core.

6. The board of claim 1, further comprising a reinforcing member embedded in said platform.

7. The board of claim 1, wherein said platform defines an anti-slip ridge formed in each knee well.

8. The board of claim 1, further comprising a pair of cushions disposed in respective ones of the pair of knee wells.

9. The board of claim 8, wherein each of said cushions defines a plurality of anti-slip ridges thereon.

10. The board of claim 1, wherein said platform is fin-free.

11. A board for traveling in ocean surf, comprising a platform having a predetermined length, said platform having a top surface, a bottom surface, a front end portion and a rear end portion, the top surface defining a pair of knee wells therein capable of accommodating knees of a user of said platform, the knee wells being of sufficient depth to facilitate guiding said platform by rotation of the knees of the user thereof in a desired direction and in a desired amount to cause said platform to rotate left or right to an extent.

12. A board for traveling in ocean surf, comprising:

(a) a platform having a predetermined length, said platform having a top surface, a bottom surface, a front end portion and a rear end portion, the top surface defining a pair of knee wells therein capable of accommodating knees of a user of said platform, the knee wells being of sufficient depth to facilitate guiding said platform by rotation of the knees of the user thereof in a desired direction and in a desired amount to cause said platform to rotate left or right to an extent, the bottom surface defining a center-most channel therein extending along a portion of the predetermined length of said platform or optionally along the entire predetermined length of said platform for increased speed of said platform; and (b) a core disposed intermediate the top surface and the bottom surface for strengthening said platform.

13. The board of claim 12, wherein the front end portion of said platform has an upturned contour in transverse cross-section.

14. The board of claim 12, further comprising a plurality of vertically-oriented fasteners engaging said core and said platform for connecting said core and said platform together.

15. The board of claim 12, further comprising a horizontally-oriented reinforcing member embedded in said platform for strengthening said platform.

16. The board of claim 12, wherein said platform defines a plurality of anti-slip ridges in each of the pair of knee wells for resisting slippage of a user's knees while the user's knees are received in respective ones of the pair of knee wells.

17. The board of claim 12, further comprising a pair of resilient cushions disposed in respective ones of the pair of knee wells for comfortably accommodating the knees of a user of said platform.

18. The board of claim 17, wherein each of said pair of resilient cushions is removable from respective ones of the pair of knee wells.

19. The board of claim 17, wherein each of said pair of resilient cushions defines a plurality of anti-slip ridges thereon for resisting slippage of the user's knees while the user's knees are comfortably accommodated by said pair of resilient cushions.

20. The board of claim 19, wherein the plurality of anti-slip ridges are optionally either transversely-oriented, longitudinally-oriented, or transversely-oriented and longitudinally-oriented.

21. The board of claim 12, wherein said platform is fin-free.

22. The board of claim 12, wherein each of the pair of knee wells defines a recessed space therein to accommodate a portion of one of the feet of the user of said platform.

23. The board of claim 12, further comprising a pair of rigid liners disposed in respective ones of said pair of knee wells for reinforcing said pair of knee wells, so that said pair of knee wells retain their original shape.

24. A board for traveling in ocean surf, comprising a platform having a predetermined length, said platform having a top surface, a bottom surface, a front end portion and a rear end portion, the top surface defining a pair of knee wells therein having a depth of about 50 percent to about 99 percent the thickness of said platform to facilitate guiding said platform by rotation of knees of a user thereof in a desired direction and in a desired amount to cause said platform to rotate left or right to an extent.

25. A method of fabricating a board for traveling in ocean surf, comprising the steps of:

(a) providing a platform having a predetermined length, the platform having a top surface, a bottom surface, a front end portion and a rear end portion;

(b) forming a pair of knee wells capable of accommodating knees of a user of the platform, the knee wells being of sufficient depth in the top surface of the platform to facilitate guiding the platform in the ocean surf by rotation of the knees of the user thereof in a desired direction and in a desired amount to cause the platform to rotate left or right to an extent; and (c) forming a center-most channel in the bottom surface of the platform, the channel extending along a portion of the predetermined length of the platform or optionally along the entire predetermined length of the platform.

26. The method of claim 25, further comprising the step of forming the front end portion of the platform into an unturned contour.

27. The method of claim 25, further comprising the step of disposing a core in the platform.

28. The method of claim 25, further comprising the step of embedding a reinforcing member in the platform.

29. The method of claim 25, further comprising the step of associating a hand-hold with the platform.

30. The method of claim 25, further comprising the step of forming an anti-slip ridge in each of the pair of knee wells.

31. The method of claim 25, further comprising the step of disposing a pair of removable cushions in respective ones of the pair of knee wells.

32. The method of claim 31, wherein the step of disposing a pair of removable cushions in respective ones of the pair of knee wells comprises the step of disposing a pair of removable cushions defining a plurality of anti-slip ridges thereon.

* * * * *